US008966679B2

(12) United States Patent
Mendes et al.

(10) Patent No.: US 8,966,679 B2
(45) Date of Patent: Mar. 3, 2015

(54) LOCKING MECHANISM FOR A PLAY YARD FRAME

(75) Inventors: Mark Mendes, Loganville, GA (US); Er-Jui Chen, Kaohsiung (TW)

(73) Assignee: Kids II, Inc., Atlanta, GA (US)

( * ) Notice: Subject to any disclaimer, the term of this patent is extended or adjusted under 35 U.S.C. 154(b) by 62 days.

(21) Appl. No.: 13/602,985

(22) Filed: Sep. 4, 2012

(65) Prior Publication Data

US 2013/0232688 A1 Sep. 12, 2013

Related U.S. Application Data

(60) Provisional application No. 61/530,467, filed on Sep. 2, 2011.

(51) Int. Cl.
*A47D 13/06* (2006.01)

(52) U.S. Cl.
USPC ..... 5/99.1; 5/93.1

(58) Field of Classification Search
USPC ..... 5/99.1, 98.1, 98.3, 93.1
See application file for complete search history.

(56) References Cited

U.S. PATENT DOCUMENTS

| | | | | |
|---|---|---|---|---|
| 6,473,919 | B1 * | 11/2002 | Wang | 5/99.1 |
| 2009/0077742 | A1 | 3/2009 | Burns et al. | |
| 2012/0012801 | A1 | 1/2012 | Burns et al. | |
| 2012/0216346 | A1 | 8/2012 | Rampton et al. | |

OTHER PUBLICATIONS

Kids II, Inc., "InGenuity Signature Edition by Bright Starts: SleepEasy Playard, Model No. 7108-3NA, " 2012, 20 pages, Kids II, Inc., China.

Kids II, Inc., "InGenuity by Bright Starts: Smart & Simple Playard, Model No. 60050-NA," 2012, 16 pages, Kids II, Inc., China.

Kids II, Inc., "Bright Starts Sunnyside Safari Playard, Model No. 7118-3NA," 2012, 12 pages, Kids II, Inc., China.

State Intellectual Property Office of the P.R.C., First Office Action for Application No. 201220445198.0, dated Jan. 8, 2013, 4 pages, China.

* cited by examiner

*Primary Examiner* — Fredrick Conley
(74) *Attorney, Agent, or Firm* — Alston & Bird LLP

(57) ABSTRACT

Various embodiments of the present invention are directed to a locking mechanism for a collapsible play yard frame. In various embodiments, the locking mechanism is configured to be adjusted between a locked position, in which the play yard frame is restricted from collapsing, and an unlocked position, in which the play yard frame is permitted to collapse. In particular embodiments, the locking mechanism is operatively connected to the play yard frame's lower frame members and includes a rotatable member configured for being rotated to adjust the locking mechanism between the locked position and the unlocked position. The locking mechanism's rotatable member enables the locking mechanism to be secured in the locked position when the play yard is in use and is easily adjusted by a user to the unlocked position when the play yard is to be collapsed for storage.

21 Claims, 7 Drawing Sheets

Square Floor Play Yard Frame

Rectangular Floor Play Yard Frame

Square Floor Play Yard Frame

Rectangular Floor Play Yard Frame

LOCKING MECHANISM FOR A PLAY YARD FRAME

CROSS-REFERENCE TO RELATED APPLICATIONS

This application claims priority from provisional U.S. Application No. 61/530,467 entitled "Locking Mechanism for a Play Yard," which was filed on Sep. 2, 2011 and is herein incorporated by reference in its entirety.

BACKGROUND OF THE INVENTION

1. Field of the Invention

Various embodiments of the present invention described herein generally relate to a locking mechanism for a frame, particularly a locking mechanism for a collapsible children's play yard frame.

2. Description of Related Art

Conventional children's play yards, also referred to as play pens, typically include a plurality of side walls, a floor, and an upper opening through which a child may be moved into and out of the play yard. These features are often defined by a frame, which may include upper and lower horizontal frame members joined by vertical frame members, and a solid fabric material positioned over the frame members. Many play yards frames are configured to be collapsible in order to allow for easier portability and storage of the play yard. For example, U.S. Publication No. 2009/0077742 discloses a collapsible frame having a release mechanism disposed on the floor of the play yard frame. A user may collapse the frame by pulling upwardly on the release mechanism, thereby causing lower horizontal frame members to fold upwardly, upper horizontal frame members to be folded downwardly, and vertical frame members to move inwardly.

However, there remains a need in the art for a collapsible play yard frame that is easier and more convenient for users to actuate when collapsing the frame, and that provides additional structural security when the frame is expanded.

BRIEF SUMMARY OF THE INVENTION

Various embodiments of the present invention are directed to a collapsible frame for a children's play yard. According to various embodiments, the frame comprises one or more lower frame members at least partially defining a floor of the play yard frame, the lower frame members being configured for movement between an expanded frame configuration and a collapsed frame configuration; and a locking mechanism operatively connected to one or more of the lower frame members, the locking mechanism comprising a rotatable member configured for being rotated to adjust the locking mechanism between a locked position and an unlocked position. In various embodiments, the locking mechanism is configured to prevent the lower frame members from being adjusted from the expanded frame configuration to the collapsed frame configuration when in the locked position, and configured to permit the lower frame members to be adjusted from the expanded frame configuration to the collapsed frame configuration when in the unlocked position.

In addition, various embodiments of the present invention are directed to a method for collapsing a children's play yard frame having one or more lower frame members, one or more vertical frame members, and a locking mechanism. In various embodiments, the method comprises setting up the play yard frame in an expanded frame configuration such that the one or more lower frame members of the play yard frame are in a substantially horizontal orientation and define a floor of the play yard; manually rotating a portion of the locking mechanism from a locked position to an unlocked position; and pulling the locking mechanism upwardly such that the lower frame members pivot upwardly with the locking mechanism and the vertical frame members move laterally towards the locking mechanism, thereby adjusting the play yard frame to a collapsed frame configuration.

In addition, various embodiments of the present invention are directed to a linking mechanism for use with collapsible children's play yard frames. According to various embodiments, the linking mechanism comprises a first connecting member configured for being pivotably connected to a first frame member of a collapsible play yard frame; and a second connecting member operatively connected to the first connecting member and configured for being pivotably connected to a second frame member of a collapsible play yard frame. In various embodiments, the second connecting member is movable relative to the first connecting member such that the position of the second connecting member relative to the first connecting member can be adjusted to accommodate various play yard frame configurations.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art Like numbers refer to like elements throughout.

Various embodiments of the present invention are directed to a locking mechanism for a collapsible play yard frame. According to various embodiments, the locking mechanism is configured to be adjusted between a locked position, in which the play yard frame is restricted from collapsing, and an unlocked position, in which the play yard frame is permitted to collapse. In particular embodiments, the locking mechanism is operatively connected to the play yard frame's lower frame members and includes a rotatable member configured for being rotated to adjust the locking mechanism between the locked position and the unlocked position. As described in greater detail below, the locking mechanism's rotatable member enables the locking mechanism to be secured in the locked position when the play yard is in use and is easily adjusted by a user to the unlocked position when the play yard is to be collapsed for storage.

Collapsible Play Yard Frame

Figure 1:
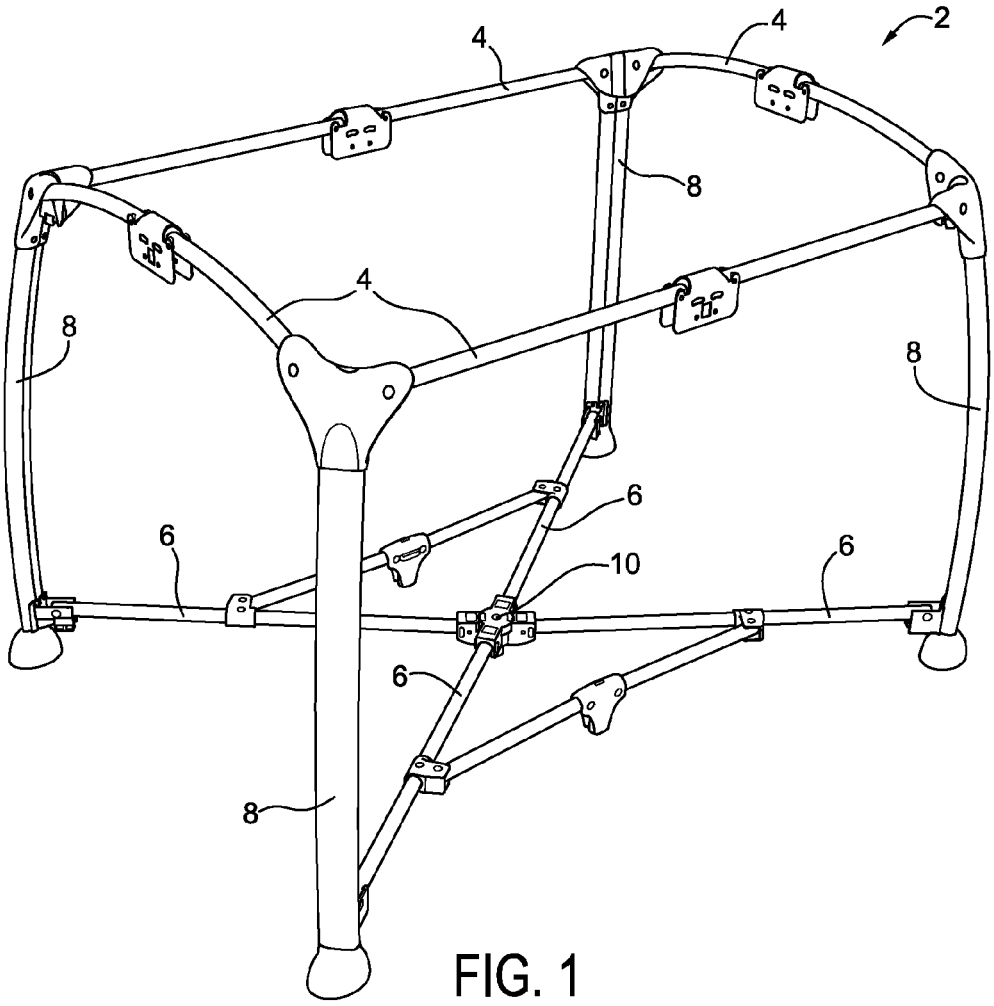
FIG. 1 shows a perspective view of a collapsible children's play yard frame in an expanded configuration according to one embodiment of the present invention.

FIG. 1 illustrates a play yard frame 2 according to one embodiment. In the illustrated embodiment, the frame 2 includes a plurality of upper horizontal frame members 4, a plurality of lower horizontal frame members 6, and four vertical frame members 8. As shown, the vertical frame members 8 are positioned at the corners of the frame 2 and include feet configured to rest on a floor or support surface. The upper horizontal frame members 4 and lower horizontal frame members 6 are connected at different heights to the vertical frame members 8 such that they are vertically spaced from one another. The upper horizontal frame members 4 extend between adjacent vertical frame members 8, thereby forming an upper perimeter of the frame 2. The lower horizontal frame members 6 are positioned inwardly from the vertical frame members 8 and are connected to one another at various points to form a play yard floor spaced above the support surface (i.e., the surface upon which the frame 2 is positioned). The terms "horizontal" and "vertical" are used herein to indicate components that are generally horizontally or vertically oriented with respect to a support surface and are not intended to indicate that particular components must be strictly or entirely horizontal or vertical.

Figure 2:
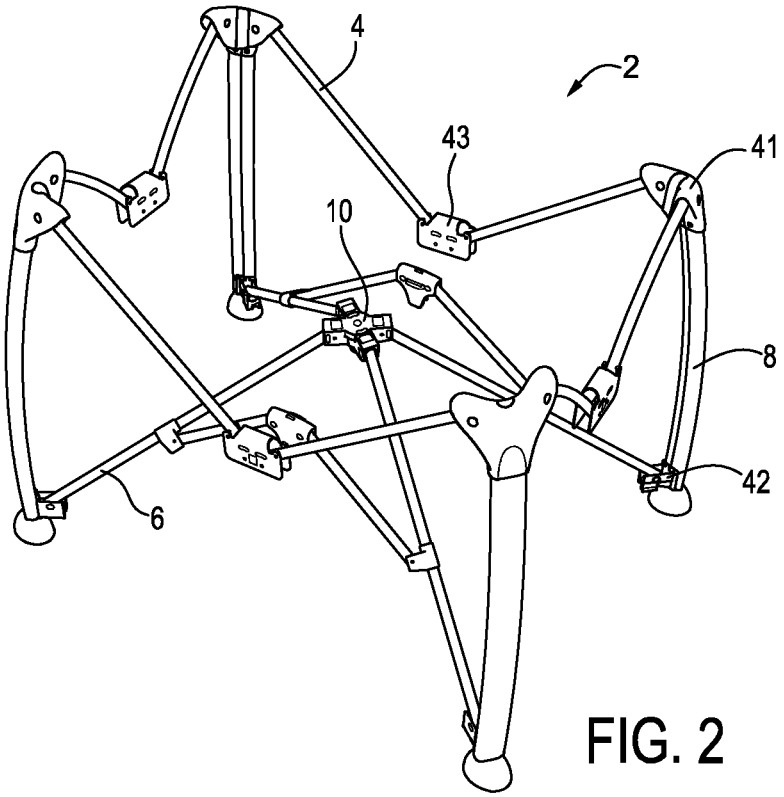
FIG. 2 shows a perspective view of a collapsible children's play yard frame in a partially collapsed configuration according to one embodiment of the present invention.

In various embodiments, the frame 2 is configured to be collapsed into a more compact form in order to minimize the space required for storage. For example, FIG. 2 illustrates the frame 2 in a partially collapsed state according to one embodiment. In the illustrated embodiment, the frame 2 includes upper connecting members 41 positioned at the upper ends of the vertical frame members 8 and upper joint members 43 disposed between the upper horizontal frame members 4. In particular, the upper horizontal frame members 4 are pivotally connected to one another by the upper joint members 43 and pivotally connected to the vertical frame members 8 by the upper connecting members 41. In the illustrated embodiment, each upper horizontal frame member 4 is secured to an upper joint member 43 and an upper connecting member 41 by pins that permit the upper horizontal frame member 4 to pivot in a downward direction. As shown in the embodiment of FIG. 2, the upper connecting members 41 and upper joint members 43 permit each of the upper horizontal frame members 4 to move downward along a plane perpendicular to a support surface on which the frame 2 rests.

Likewise, the frame 2 also includes lower connecting members 42 positioned at the lower ends of the vertical frame members 8 and a locking mechanism 10 positioned centrally in the play yard frame's floor. In the illustrated embodiment, each of the lower horizontal frame members 6 is pivotally connected proximate its outer end to the vertical frame members 8 by the lower connecting members 42. In addition, each of the lower horizontal frame members 6 is pivotally connected to the locking mechanism 10 proximate its inner end. As will be appreciated from FIG. 2, additional lower cross-members may be provided between the lower horizontal frame members 6 to provide additional structural stability. In the illustrated embodiment, the lower horizontal frame members 6 are secured to the connecting members 42 and locking mechanism 10 by pins that permit the lower horizontal frame members 6 to pivot in an upward direction. However, as will be appreciated from the description herein, the various upper and lower horizontal frame members 4, 6 may be secured by various other fastening mechanisms permitting the frame members to move between an expanded and collapsed state.

Figure 3:
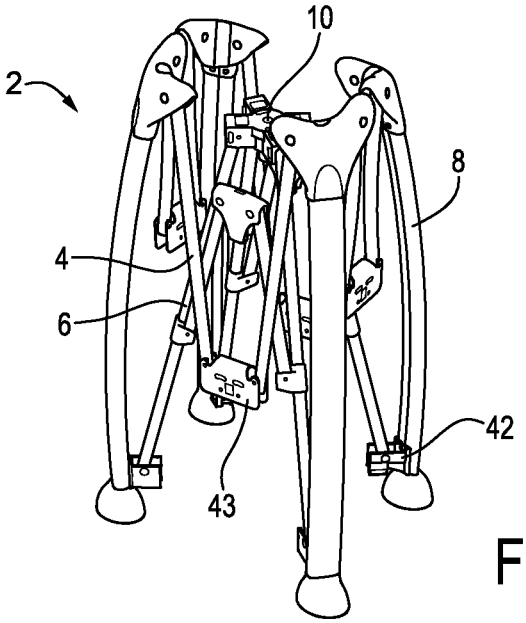
FIG. 3 shows a perspective view of a collapsible children's play yard frame in a collapsed configuration according to one embodiment of the present invention.

FIG. 3 illustrates the frame 2 in a fully collapsed state according to one embodiment. As described in greater detail below, the frame 2 can be collapsed into the configuration of FIG. 3 by pivoting the upper horizontal frame members 4 downward and the lower horizontal frame members 6 upward, thereby moving the vertical frame members 8 inward and adjacent one another.

Locking Mechanism

Figure 4:
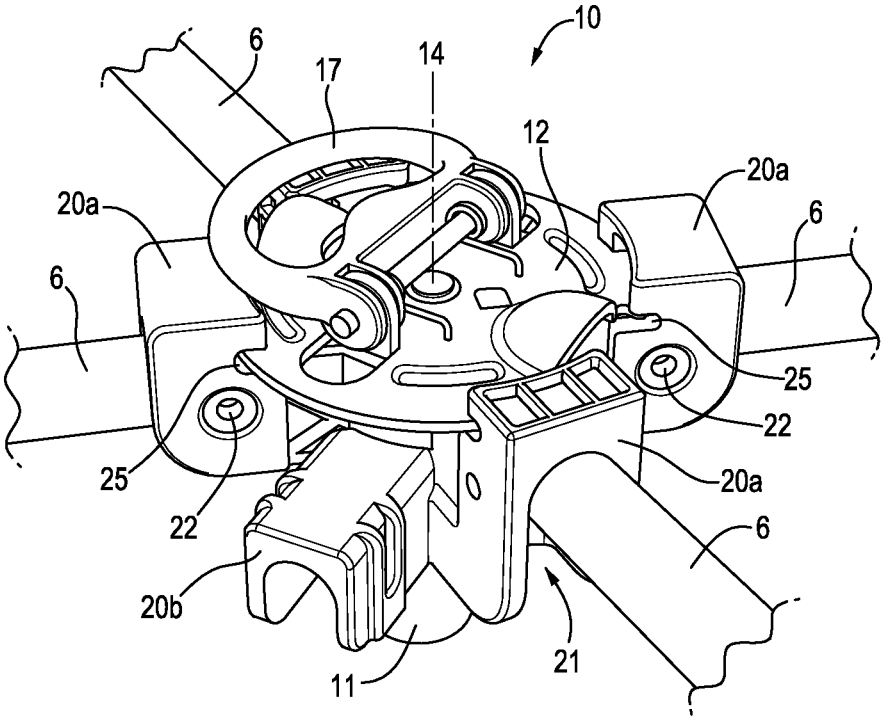
FIG. 4 shows a perspective view of a locking mechanism in a locked configuration and an associated handle in a lay-flat position according to one embodiment of the present invention.

FIG. 4 shows a detailed perspective view of the locking mechanism 10 according to one embodiment. As shown in FIG. 4, the locking mechanism 10 generally comprises a hub member 11, a rotatable plate 12, and a handle 17. In the illustrated embodiment, hub member 11 includes four collar members 20*a*, which extend radially outwardly from the hub member 11. Each collar member 20*a* defines an interior area 21, within which an inner-most end of one the lower horizontal frame members 6 is disposed. Each of the lower horizontal frame members 6 is secured at its inner-most end to a respective collar member 20*a* by a pin 22. As will be appreciated from FIG. 4, the pins 22 generally permit each lower horizontal frame member 6 to pivot about its inner-most end relative to the locking mechanism 10. As such, each of the lower horizontal frame members 6 are pivotably connected to the hub member 11. In the illustrated embodiment, the hub member 11 also includes auxiliary collar members 20*b*, to which additional lower horizontal frame members 6 may be secured in various other embodiments.

As shown in FIG. 4, the rotatable plate 12 is rotatably connected to an upper surface of the hub member 11. In the illustrated embodiment, the rotatable plate 12 is substantially circular. However, according to various other embodiments, the plate 12 may be any suitable shape. In various embodiments, the rotatable plate 12 and hub member 11 are configured such that the rotatable plate 12 rotates about a substantially vertical axis 14, which extends longitudinally through the hub member 11. In addition, the rotatable plate 12 is dimensioned such that outer portions of the plate 12 pass through recessed areas 25 defined on an inner side of each collar member 20*a*. These recessed areas 25 are open to the inner area 21 of each respective collar member 20*a* such that portions of the plate 25 positioned within the recessed areas 25 are at least partially disposed within the interior areas 21.

With the rotatable plate 12 in the position shown in FIG. 4, the locking mechanism 10 is in a locked position that prevents the play yard frame 2 from being collapsed. As noted earlier herein, the play yard frame 2 may be collapsed by moving the locking mechanism 10 upwardly such that the lower horizontal frame members 6 pivot toward a vertical orientation and move inwardly (e.g., as shown in FIGS. 2 and 3). As this occurs, each respective lower horizontal frame member 6 rotates about its associated pin 22 such that its inner-most end (i.e., the portion of the frame member 6 positioned past the pin 22 toward the center of the hub member 11) pivots upwardly within the interior area 21 of a collar member 20*a* and toward the bottom surface of the rotatable plate 12. Thus, with the locking mechanism 10 in the locked position of FIG. 4, the inner-most end of each lower horizontal frame member 6 is aligned beneath a portion of the rotatable plate 12 disposed within the recessed area 25 and will engage this portion of the rotatable plate 12 when pivoted. As such, the lower horizontal frame members 6 are prevented from pivoting toward the collapsed configuration of FIG. 3 with the locking mechanism 10 in its locked position.

Figure 5:
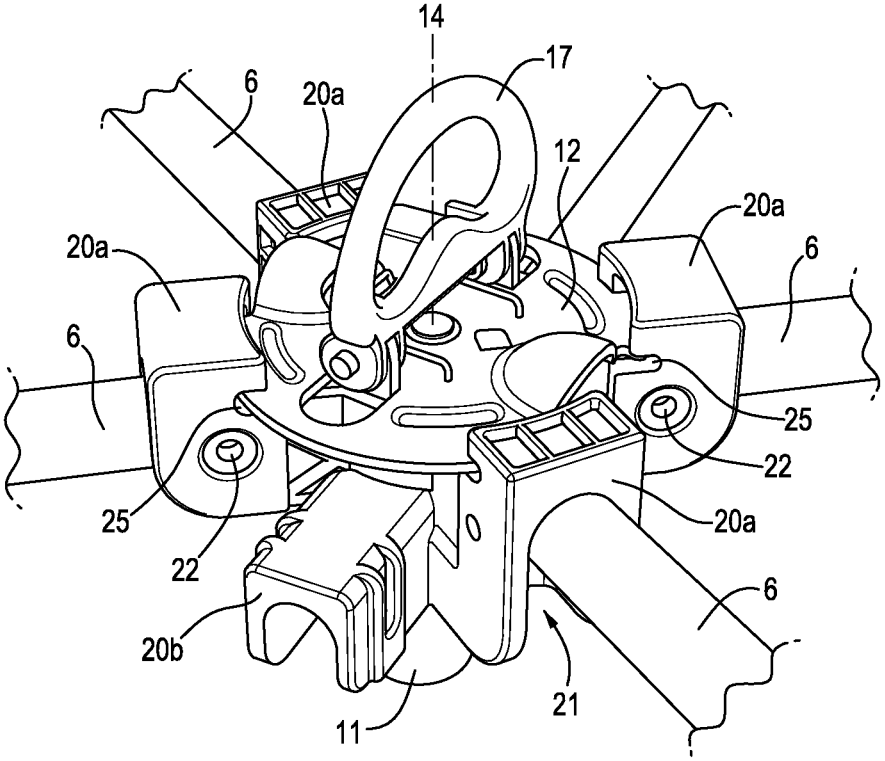
FIG. 5 shows a perspective view of a locking mechanism in a locked configuration and an associated handle in an upright position according to one embodiment of the present invention.

According to various embodiments, the locking mechanism 10 may be adjusted to an unlocked position by rotating the rotatable plate 12. For example, as shown in FIG. 4, the locking mechanism 10 includes a handle 17, which is pivotably connected to an upper surface of the rotatable plate 12 (e.g., by pins). FIG. 4 shows the handle 17 in a lay-flat configuration, in which it is oriented substantially parallel to the lower horizontal frame members 6. To rotate the rotatable member 12, the handle 17 can be grasped and pivoted upwardly to the upright orientation shown in FIG. 5. With the handle 17 in the upright orientation of FIG. 5, a user can easily twist the handle 17 such that it is rotated about the axis 14 (which is substantially perpendicular to the play yard floor when the frame 2 is in the expanded configuration of FIG. 1), thereby rotating the rotatable member 12 about the axis 14.

Figure 6:
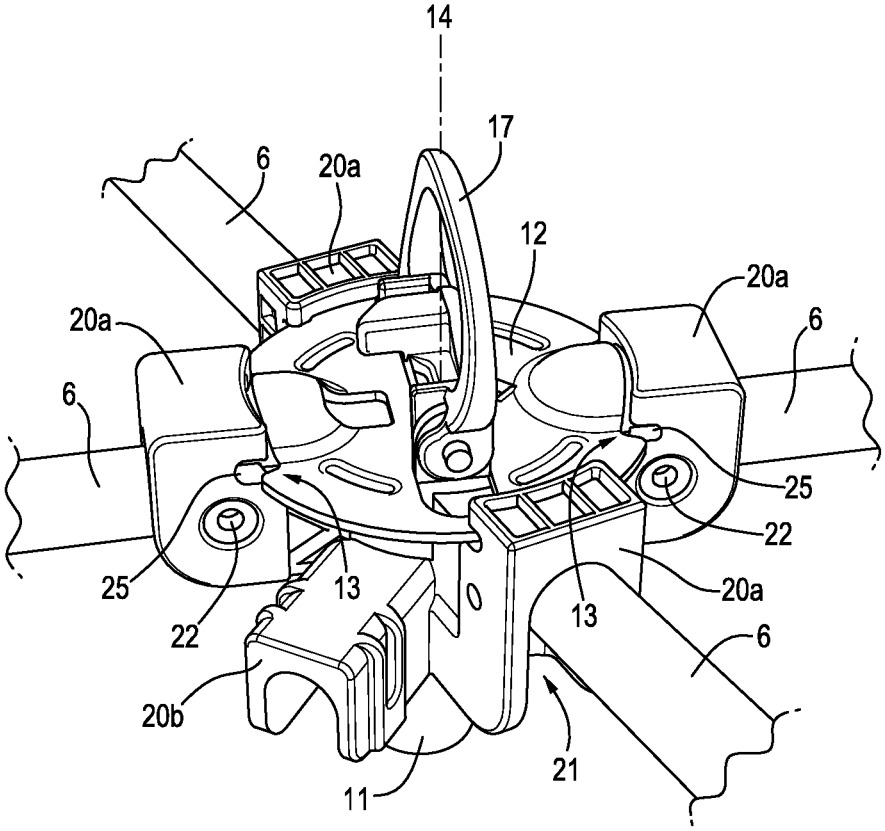
FIG. 6 shows a perspective view of a locking mechanism in an unlocked configuration and an associated handle in an upright position according to one embodiment of the present invention.

FIG. 6 shows the locking mechanism 10 in an unlocked position. As shown in FIG. 6, the rotatable plate 12 defines an outer perimeter having recessed portions 13. The recessed portions 13 are positioned such that, when the rotatable plate 12 is rotated to the locking mechanism's unlocked position, the recessed portions 13 are aligned with the collar members 20*a*. In this position, the recessed portions 13 of the rotatable plate 12 do not extend through the collar member's recessed portions 25 and into the interior area 21. As a result, the rotatable plate 12 will not obstruct the lower horizontal frame members 6 from pivoting about their respective pins 22 toward the collapsed configuration shown in FIG. 3.

In the illustrated embodiment, the locking mechanism 10 also includes an internal spring (not shown) operatively connected to the rotatable plate 12 and configured to bias the plate toward the locked position. As such, the spring functions as a biasing component to prevent the locking mechanism 10 from being adjusted to the unlocked configuration absent deliberate force by a user. For example, in the illustrated embodiment, a user must apply a torque on the handle 17 in a direction toward the unlocked position that is sufficient to overcome the biasing force of the spring in order to adjust the locking mechanism 10 from the locked position to the unlocked position. In addition, in certain embodiments, the hub member 11 may be configured to prevent the rotatable plate 12 from rotating in a direction opposite the unlocked position when the locking mechanism 10 is in its locked position.

In certain embodiments, the locking mechanism 10 also includes secondary locking means which must be released by a caregiver before the rotatable plate 12 can be rotated to the unlocked position (or returned to locked position). For example, in one embodiment, the secondary locking means may comprise the handle 17 where the handle 17 is configured to prevent movement of the rotatable plate 12 when the handle is in the lay-flat orientation (e.g., by engaging one of the collar members 20*a* or via other means). In such embodiments, rotating the handle 17 to its upright orientation would then permit the rotatable plate 12 to be rotated.

As will be appreciated from the description herein, the locking mechanism 10 permits the play yard frame 2 to be conveniently secured in an expanded frame configuration (e.g., that of FIG. 1) and easily adjusted to a collapsed frame configuration (e.g., that of FIG. 3). In particular, to collapse the play yard frame 2, a user may first grasp the handle 17 and lift it to its upright orientation. Next the user may rotate the handle about the axis 14 from the locked position to the unlocked position. Notably, in embodiments in which the rotatable plate 12 is prevented from rotating in a direction opposite the unlocked position when the locking mechanism 10 is in its locked position, it is easy for a user to understand which direction to rotate the handle 17. In addition, in embodiments in which the hub member 11 includes a biasing component, the biasing force implies to the user that the locking mechanism 10 is being disengaged and requires deliberate force by the user to be moved from the locked position to the unlocked position.

Once the locking mechanism 10 is adjusted to the unlocked position, the user may manually pull the locking mechanism 10 upwardly (e.g., via the handle 17) such that the lower frame members 6 pivot upwardly with the locking mechanism 10 and the vertical frame members 8 move laterally towards the locking mechanism 10, thereby adjusting the play yard frame 2 to the collapsed frame configuration. As will be appreciated from the description herein, this method of collapsing the play yard frame 2 is both safe and convenient for a user. In addition, as a child positioned in the play yard could not perform these steps (e.g., pulling up on the handle 17), the locking mechanism 10 serves as a safety feature preventing inadvertent collapsing of the play yard.

Various Other Embodiments

As will be appreciated from the description herein, various changes and modifications to the locking mechanism 10 and play yard frame 2 are contemplated as being within the scope of the present invention. For example, as will be appreciated from the description herein, not all of the lower horizontal frame members 6 must be engaged by the rotatable plate 12. Indeed, in certain embodiments, the rotatable plate 12 is configured to engage only one of the lower horizontal frame members 6 (e.g., in embodiments in which only one collar member 20*a* is provided and the remaining frame members are rotatably connected to the hub member 11 elsewhere, such as the collar members 20*b*). In such embodiments, the engagement of one lower horizontal frame member would still prevent the play yard 2 from being collapsed. In other embodiments, the rotatable plate 12 is configured to engage all of the lower horizontal frame members 6 when in the locked position. Accordingly, in various embodiments, any number of collar members 20*a* may be provided.

In addition, according to various embodiments, the locking mechanism 10 may be configured such that, in the locked position, the lower horizontal frame members 6 are fully restricted from pivoting away from the expanded frame configuration (e.g., such that the lower frame members cannot be moved upwardly at all). In other embodiments, the locking mechanism 10 may be configured such that, in the locked position, the lower horizontal frame members 6 are able to move upwardly slightly before engaging the rotatable plate 12 and being prevented from moving further towards the collapsed frame configuration.

In addition, the hub member 11 may be configured such that the rotatable plate 12 functions in an analogous way with other structures and orientations. For example, the hub member 11 may be configured in a variety of shapes and sizes and may be comprised of one or more separate, joined members. In addition, in various embodiments, the plate 12 may have any suitable profile (e.g., a square plate configured such that its pointed edges engage the lower frame members 6 in the locked configuration). Moreover, the handle 17 may be formed as part of the rotatable plate and may be provided in other orientations or configurations. In various other embodiments of the locking mechanism 10 may include alternative secondary locking means, such as, for example, a removable locking pin.

Furthermore, in various embodiments, the play yard frame 2 may include any number of lower frame members 6. In addition, the play yard frame 2 may be generally configured in a variety of shapes and orientations. Indeed, the configuration of the locking mechanism 10 permits the locking mechanism 10 to be used with a variety of play yard frame configurations (e.g., circular, rectangular, or square play yard frames). In various embodiments, the play yard frame may include any number of vertical frame members, which may be arranged in a variety of ways. Further, in various embodiments, the play yard frame's upper and lower horizontal frame members may be comprised of any number of individual members, including a single, unitary upper or lower horizontal frame member.

Adjustable Linking Mechanism

Figure 7:
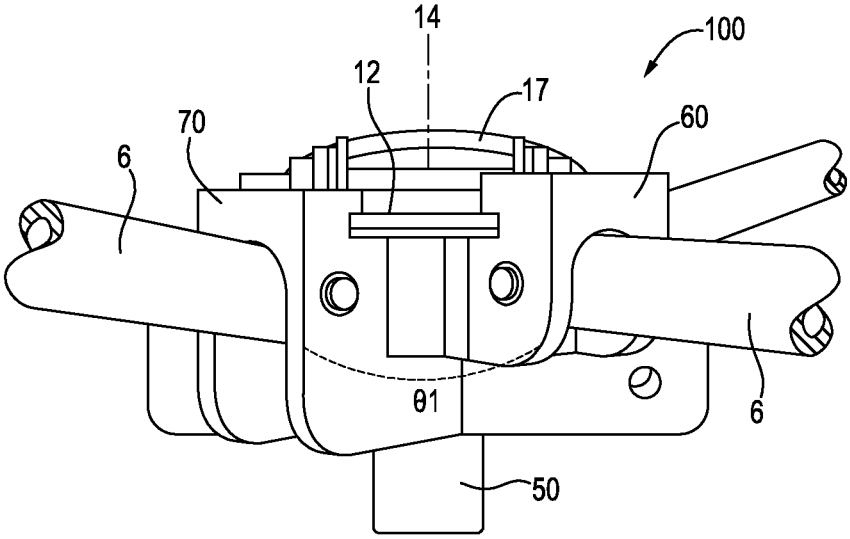
FIG. 7 shows a perspective view of a linking mechanism in a wide angle configuration according to one embodiment of the present invention.

FIG. 7 shows a linking mechanism 100 according to another embodiment of the present invention. In various embodiments, the linking mechanism 100 is configured for linking frame members of a collapsible play yard frame. For example, in the illustrated embodiment of FIG. 7, the linking mechanism 100 is positioned centrally in the floor of a play yard frame and configured for linking various lower horizontal frame members 6. According to various embodiments, the linking mechanism 100 is adjustable such that it can be adapted for use with various play yard frame configurations (e.g., play yard frames having square, rectangular, or circular floors), in which the lower horizontal frame members 6 intersect the linking mechanism 100 at different angles.

In the illustrated embodiment of FIG. 7, the linking mechanism 100 generally comprises a hub member 50, a first connecting member 60, and a second connecting member 70. As shown in FIG. 7, the linking mechanism's hub member 50 is vertically oriented and defines central vertical axis 14. The first connecting member 60 and the second connecting member 70 are each oriented generally horizontally (e.g., perpendicular to the vertical axis 14) and are rotatably connected to the hub member 50 such that each may rotated about the central vertical axis 14. In particular, as shown in FIG. 7, the first connecting member 60 is rotatably connected to the hub member 50 at a height above the second connecting member 70 with the hub member 50 extending vertically through central portions of the first and second connecting members 60, 70. As a result of this configuration, the first connecting member 60 and second connecting member 70 extend outwardly from the hub member 50 and define an angle θ1 between one another.

As will be appreciated from FIG. 7, the ends of the first connecting member 60 and second connecting member 70 are configured analogously to the collar members 20*a* in the above described locking mechanism 10. As such, lower horizontal frame members 6 are pivotably connected to ends the first connecting member 60 and second connecting member 70. In particular, the lower horizontal frame members 6 are disposed within interior portions of first ends of the first connecting members 60, 70 by pins (e.g., in the manner described above using the pins 22 and interior areas 21 of the collar members 20*a*). In addition, second ends of the first connecting members 60, 70 (e.g., opposite the first ends shown in FIGS. 7, and 8) may be similarly configured and may be pivotally connected to additional lower horizontal frame members 6 on the opposite side of the linking mechanism 100.

Figure 9:
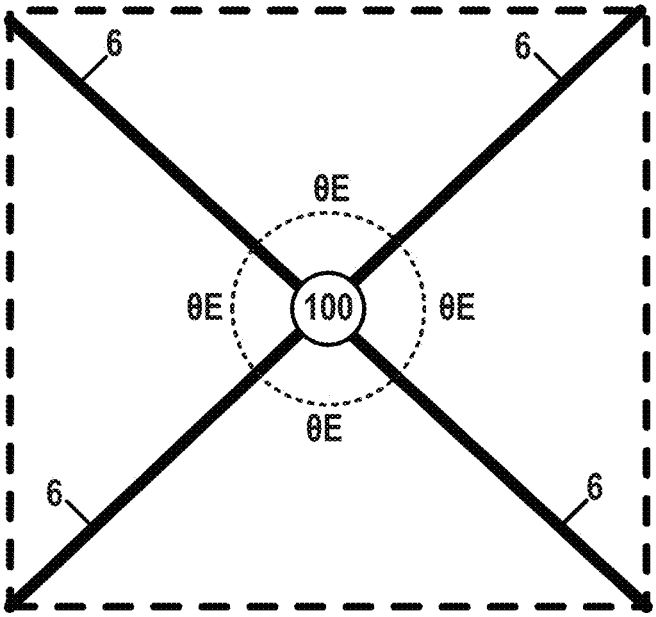
FIG. 9 shows schematic views of a square floor play yard frame having a linking mechanism and a rectangular floor play yard frame having a linking mechanism according to various embodiments of the present invention.
Figure 9:
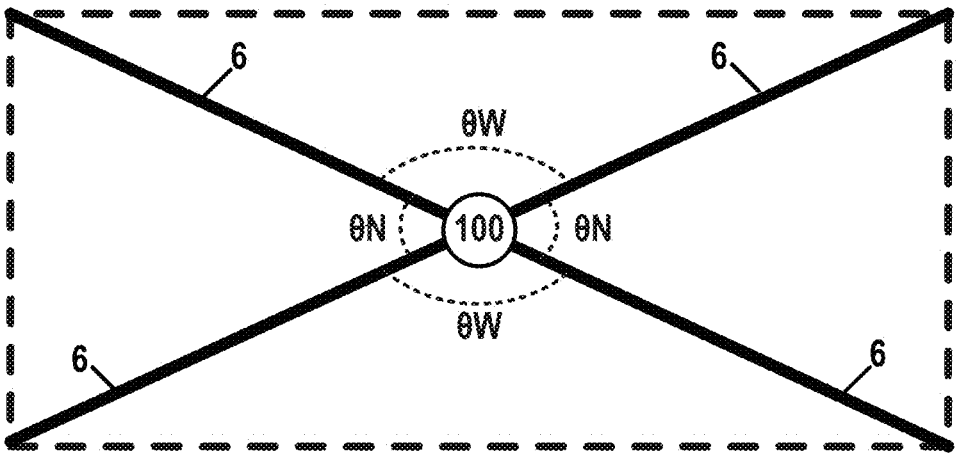

As the lower horizontal frame members 6 are pivotably connected to the linking mechanism 100, the linking mechanism 100 enables the lower horizontal frame members 6 to be linked together and pivoted between an expanded frame configuration (e.g., the configuration of FIG. 1) and a collapsed frame configuration (e.g., the configuration of FIG. 3). However, various play yard configurations may result in the lower frame members 6 intersecting the linking mechanism 100 at different angles. For example, FIG. 9 shows a schematic diagram of a square floor play yard frame and a rectangular floor play yard frame. As shown in FIG. 9, the lower horizontal frame members 6 of the square floor play yard frame are pivotably connected to the linking mechanism 100 at evenly spaced angles θE. In contrast, the lower horizontal frame members 6 of the rectangular floor play yard frame are pivotably connected to the linking mechanism 100 at wide angles θW and narrow angles θN.

Figure 8:
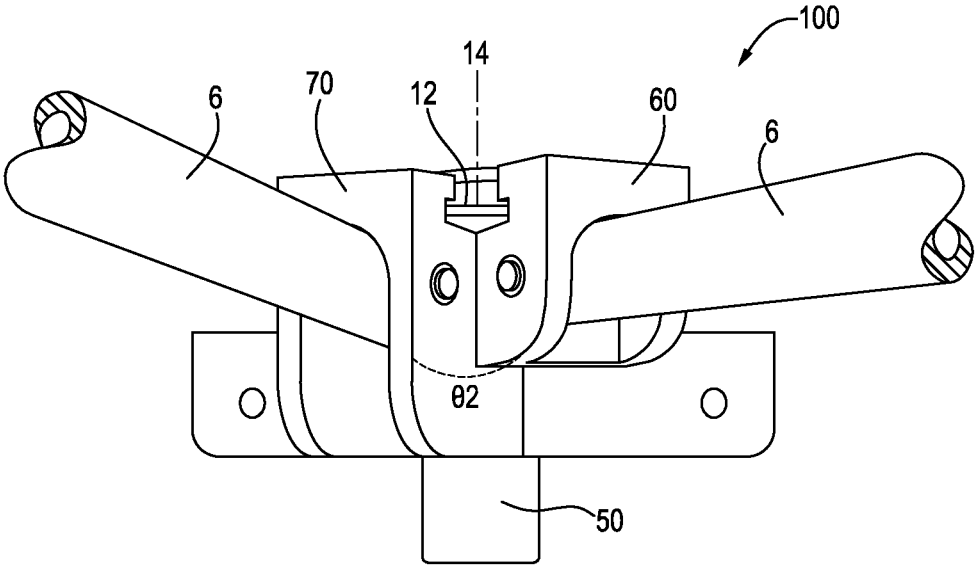
FIG. 8 shows a perspective view of a linking mechanism in a narrow angle configuration according to one embodiment of the present invention.

As the linking mechanism's first connecting member 60 and second connecting member 70 are rotatably connected to the hub member 50, the position of the connecting members 60, 70 relative to one another can be adjusted to accommodate various play yard frame configurations (e.g., the square or rectangular frames show in FIG. 9). For example, FIG. 7 illustrates the linking mechanism 100 in a first configuration in which the first connecting member 60 and second connecting member 70 are separated by an angle θ1. FIG. 8 illustrates the linking mechanism 100 in a second configuration in which the connecting members 60, 70 have been adjusted closer to one another and are separated by a smaller angle θ2. As such, the linking mechanism 100 can be reconfigured for use with different play yard frame configurations. This can be advantageous as it enables one type of linking mechanism 100 to be manufactured for use with different play yard frames, thereby reducing manufacturing costs and improving production efficiencies.

Additionally, in the illustrated embodiment of FIG. 7, the linking mechanism 100 also includes a rotatable plate 12 and handle 17, which may be configured to function as a locking component in the manner described above in relation to the locking mechanism 10 (e.g., where the plate 12 is rotatable about the axis 14 and is configured for extending at least partially into recesses 25 defined by the first connecting members 60, 70). As such, the linking mechanism 100 can be adjusted between a locked position, in which the frame members 6 are prevented from being adjusted from the expanded frame configuration to the collapsed frame configuration, and an unlocked position, in which the frame members 6 are permitted to move from expanded frame configuration to the collapsed frame configuration.

As will be appreciated from the description herein, various changes and modifications to the linking mechanism 100 are contemplated as being within the scope of the present invention. For example, as will be appreciated from the description herein, the linking mechanism 100 may include additional connecting members to accommodate play yard frames having additional lower frame members. In addition, the connecting members 60, 70 may be configured such that their position may be adjusted by any suitable means (e.g., using tracks, joints, or other linkages provided on the linking mechanism 100 to enable the connecting members 60, 70 to be moved relative to one another). In addition, the linking mechanism 100 may be provided with or without a locking component. Moreover, the linking mechanism 100 (and locking mechanism 10) may be adapted for use with any portion of a play yard frame and are not restricted to use in a play yard floor.

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A collapsible frame for a children's play yard, the frame comprising:

one or more lower frame members at least partially defining a floor of the play yard frame, the lower frame members being configured for movement between an expanded frame configuration and a collapsed frame configuration; and a locking mechanism operatively connected to one or more of the lower frame members, the locking mechanism comprising:

a hub member; and a rotatable member rotatably connected to the hub member, the rotatable member configured for being rotated to adjust the locking mechanism between a locked position and an unlocked position;

wherein the locking mechanism is configured to prevent the lower frame members from being adjusted from the expanded frame configuration to the collapsed frame configuration when in the locked position, and wherein the locking mechanism is configured to permit the lower frame members to be adjusted from the expanded frame configuration to the collapsed frame configuration when in the unlocked position; and wherein at least one of the lower frame members is pivotably connected to the hub member at a height beneath the rotatable member such that, when the locking mechanism is in the locked position, a lower surface of the rotatable member will engage the at least one of the lower frame members where the at least one of the lower frame members is pivoted upwardly toward the collapsed frame configuration and, when the locking mechanism is in the unlocked position, the lower surface of the rotatable member will not engage the at least one of the lower frame members where the at least one of the lower frame members is pivoted upwardly toward the collapsed frame configuration.

2. The collapsible frame of claim 1, wherein the locking mechanism further comprises a handle operatively connected to the rotatable member and configured to enable a user to manually rotate the rotatable member between the locked and unlocked positions.

3. The collapsible frame of claim 2, wherein the handle is configured for being rotated about an axis substantially perpendicular to the floor of the play yard frame when the lower frame members are in the expanded configuration.

4. The collapsible frame of claim 2, wherein the handle is pivotable relative to the rotatable member between a lay-flat orientation and an upright orientation.

5. The collapsible frame of claim 1, wherein the locking mechanism includes a biasing component configured to bias the rotatable member toward the locked configuration.

6. The collapsible frame of claim 5, wherein the biasing component comprises a spring.

7. The collapsible frame of claim 5, wherein, when the locking mechanism is in the locked position, the rotatable member is substantially restricted from rotation in a direction opposite the unlocked position.

8. The collapsible frame of claim 1, wherein the one or more lower frame members comprise one or more lower horizontal frame members; and wherein the collapsible frame further comprises:

one or more vertical frame members attached to the lower frame members, at least a portion of the vertical frame members extending upwardly from the lower horizontal frame members; and one or more upper horizontal frame members defining an upper perimeter of the play yard frame.

9. The collapsible frame of claim 1, wherein the lower frame members are rotatably connected to the locking mechanism such that:

the locking mechanism is positioned substantially centrally in the floor of the play yard frame when the lower frame members are in the expanded frame configuration; and the locking mechanism moves upwardly when the lower frame members are moved from the expanded frame configuration to the collapsed frame configuration.

10. The collapsible frame of claim 1, wherein the rotatable member comprises a substantially circular plate defining an outer perimeter, the second portion of the rotatable member comprising a recessed portion of the plate's outer perimeter.

11. The collapsible frame of claim 1, wherein:

the hub member defines a central vertical axis;

the rotatable member is configured to rotate about the central vertical axis; and the at least one of the lower frame members is configured to pivot about a horizontal axis substantially perpendicular to the hub member's central vertical axis.

12. A method for collapsing a children's play yard frame having one or more lower frame members, one or more vertical frame members, and a locking mechanism, the method comprising:

setting up the play yard frame in an expanded frame configuration such that the one or more lower frame members of the play yard frame are in a substantially horizontal orientation and define a floor of the play yard;

manually rotating a rotatable member of the locking mechanism from a locked position to an unlocked position such that a lower surface of the rotatable member will no longer engage the one or more lower frame members of the play yard frame;

pulling the locking mechanism upwardly such that the lower frame members pivot upwardly with the locking mechanism and the vertical frame members move laterally towards the locking mechanism, thereby adjusting the play yard frame to a collapsed frame configuration.

13. The method of claim 12, wherein the step of manually rotating a portion of the locking mechanism from a locked position to an unlocked position comprises:

grasping a handle of the locking mechanism; and rotating the handle about a substantially vertical axis of rotation.

14. The method of claim 13, wherein the step of grasping the handle of the locking mechanism comprises:

grasping the handle of the locking mechanism in a lay-flat orientation; and pivoting the handle of the locking mechanism upwardly to an upright orientation substantially parallel to the vertical axis of rotation.

15. The method of claim 12, wherein the step of manually rotating a portion of the locking mechanism from a locked position to an unlocked position comprises:

manually applying a torque on the locking mechanism in a direction toward the unlocked position and opposite a biasing force provided by a biasing component of the locking mechanism, the torque being of sufficient magnitude to overcome the biasing force and adjust the locking mechanism from the locked orientation to the unlocked position.

16. A linking mechanism for use with collapsible children's play yard frames, the linking mechanism comprising:

a first connecting member configured for being pivotably connected to a first frame member of a collapsible play yard frame; and a second connecting member operatively connected to the first connecting member and configured for being pivotably connected to a second frame member of the collapsible play yard frame, wherein the first connecting member and the second connecting member are configured to rotate relative to one another about a vertical axis such that an angle defined between the first connecting member and the second connecting member is adjustable to accommodate various play yard frame configurations.

17. The linking mechanism of claim 16, wherein the second connecting member is rotatable relative to the first connecting member such that an angle between the first connecting member and the second connecting member is adjustable.

18. The linking mechanism of claim 17, further comprising a hub member defining a central vertical axis;

wherein the first connecting member and second connecting member are rotatably connected to the hub member and configured for rotating about the central vertical axis.

19. The linking mechanism of claim 18, wherein the first connecting member is rotatably connected to the hub member at height above the second connecting member.

20. The linking mechanism of claim 18, wherein the first connecting member is oriented generally horizontally and defines a first end and a second end, the first connecting member's first end configured for being pivotably connected to the first frame member of a collapsible play yard and the first connecting member's second end configured for being pivotably connected to a third frame member of a collapsible play yard;

wherein the second connecting member is oriented generally horizontally and defines a first end and a second end, the second connecting member's first end configured for being pivotably connected to the second frame member of a collapsible play yard and the second connecting member's second end configured for being pivotably connected to a fourth frame member of a collapsible play yard.

21. The linking mechanism of claim 18, further comprising a rotatable plate rotatably connected to the hub member above the first connecting member and the second connecting member, the rotatable plate configured for being rotated to adjust the linking mechanism between a locked position and an unlocked position;

wherein the rotatable plate is configured to prevent the first frame member and the second frame member from being adjusted from an expanded frame configuration to a collapsed frame configuration when in the locked position, and wherein the linking mechanism is configured to permit the first frame member and the second frame member to be adjusted from the expanded frame configuration to the collapsed frame configuration when in the unlocked position.

* * * * *